US006784142B2

(12) United States Patent
Van Dam et al.

(10) Patent No.: US 6,784,142 B2
(45) Date of Patent: Aug. 31, 2004

(54) LUBRICATING OIL COMPOSITION COMPRISING BORATED AND EC-TREATED SUCCINIMIDES AND PHENOLIC ANTIOXIDANTS

(75) Inventors: Willem Van Dam, Novato, CA (US); Peter Kleijwegt, Heinenoord (NL)

(73) Assignees: Chevron Oronite Company LLC, San Ramon, CA (US); Chevron Oronite Technology B.V., Rotterdam (NL)

( * ) Notice: Subject to any disclaimer, the term of this patent is extended or adjusted under 35 U.S.C. 154(b) by 0 days.

(21) Appl. No.: 10/367,557

(22) Filed: Feb. 14, 2003

(65) Prior Publication Data

US 2003/0171224 A1 Sep. 11, 2003

Related U.S. Application Data

(60) Provisional application No. 60/357,028, filed on Feb. 14, 2002.

(51) Int. Cl.[7] ..... C10M 141/12; C10M 157/10

(52) U.S. Cl. ..... 508/192; 508/221; 508/222; 508/501; 508/503

(58) Field of Search ..... 508/192, 221, 508/516

(56) References Cited

U.S. PATENT DOCUMENTS

| | | | | |
|---|---|---|---|---|
| 4,713,187 A | * | 12/1987 | Buckley et al. | 508/192 |
| 5,334,321 A | | 8/1994 | Harrison et al. | 252/51.5 A |
| 5,356,552 A | | 10/1994 | Harrison et al. | 252/51.5 A |
| 5,716,912 A | | 2/1998 | Harrison et al. | 508/192 |
| 5,861,363 A | | 1/1999 | Willis, Jr. et al. | 508/192 |
| 6,001,780 A | * | 12/1999 | Ho et al. | 508/192 |
| 6,146,431 A | * | 11/2000 | Harrison et al. | 44/331 |
| 6,214,775 B1 | * | 4/2001 | Harrison | 508/222 |
| 6,294,506 B1 | * | 9/2001 | Friesen et al. | 508/287 |
| 6,642,191 B2 | | 11/2003 | Palazzotto et al. | 508/501 |
| 2003/0139304 A1 | | 7/2003 | Palazzotto et al. | 508/503 |

FOREIGN PATENT DOCUMENTS

| | | | |
|---|---|---|---|
| WO | 03/048278 A1 | 6/2003 | C10M/129/10 |

OTHER PUBLICATIONS www.cromptoncorp.com, Crompton Olefins & Styrenics Additives, "Polyol Stabilizers" Product Information (Naugard®PS–48), Nov. 20, 2001.

Ciba Specialty Chemicals Inc., Additives, Reference AD7, Publ. No. 28969/96/e, "Ciba® IRGANOX® L 118", 1996.

Ciba Specialty Chemicals Inc., Additives, Reference AD7, Publ. No. 28970/96/e, "Ciba® IRGANOX® L 135", 1996.

* cited by examiner

*Primary Examiner*—Ellen M McAvoy
(74) *Attorney, Agent, or Firm*—Josetta I. Jones; Sarita R. Kelley

(57) ABSTRACT

An additive package comprising one or more borated dispersants, one or more EC-treated dispersants, and one or more phenolic antioxidants; a lubricating oil composition comprising said additive package; and a method of controlling bearing corrosion and valve train wear using said lubricating oil.

12 Claims, No Drawings

LUBRICATING OIL COMPOSITION COMPRISING BORATED AND EC-TREATED SUCCINIMIDES AND PHENOLIC ANTIOXIDANTS

This application claims the benefit of priority from U.S. Provisional Application No. 60/357,028, filed Feb. 14, 2002.

BACKGROUND OF THE INVENTION

Lubricating oil deterioration and nitration is a problem with any lubricating oil when used in an engine. This problem is exacerbated in diesel engines that the system because the level of NOx produced in such engines promotes oil nitration and deterioration.

Elevated temperatures typically found in engines affect lubricating oil deterioration and increase the level of acid contamination. This problem is exacerbated in heavy-duty diesel engines equipped with exhaust gas re-circulation systems because the operating temperatures for these engines are higher than other types of engines. The level of acid contamination is also higher than other types of engines. Higher operating temperatures and acid contamination may result in increased bearing corrosion. Lubricating engines with the lubricating oil of this invention resulted in improved bearing corrosion control in heavy-duty diesel engines.

SUMMARY OF THE INVENTION

It has now been discovered that the combination of one or more EC-treated polyalkene succinimides and one or more borated polyalkene succinimides with a specific phenolic antioxidant controls bearing corrosion and controls valve train wear.

Accordingly, the present invention comprises:

A lubricating oil additive composition comprising:

(a) one or more ethylene carbonate-treated succinimides, (b) one or more borated succinimides, and (c) one or more phenolic antioxidants selected from those of the formulae:

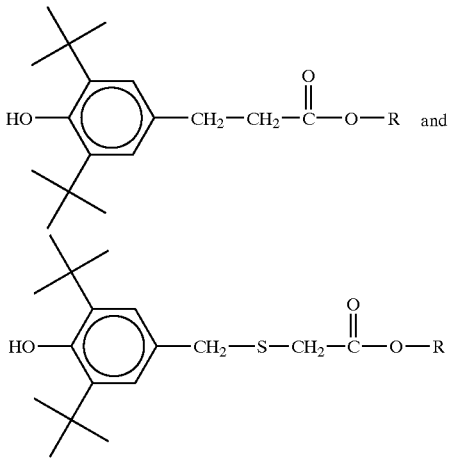

wherein each R is an alkyl group of 7 to 9 carbon atoms.

The present invention further provides:

A lubricating oil composition comprising a major amount of an oil of lubricating viscosity and a minor amount of the lubricating oil additive composition comprising:

(a) one or more ethylene carbonate-treated succinimides, (b) one or more borated succinimides, and (c) one or more phenolic antioxidants selected from those of the formulae:

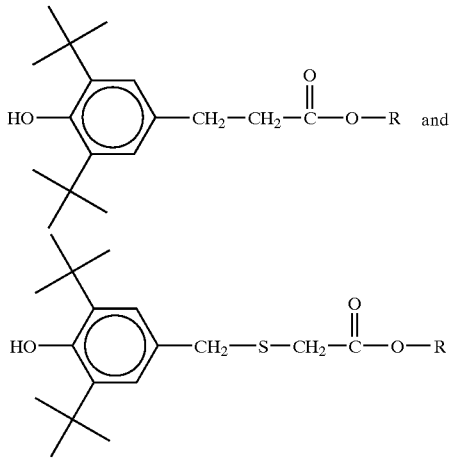

wherein each R is an alkyl group of 7 to 9 carbon atoms.

The present invention additionally provides a method of lubricating an engine comprising operating the engine with the lubricating oil composition of the present invention.

The present invention additionally provides a method for reducing valve train wear in diesel engines comprising lubricating the diesel engine with the lubricating oil composition of the present invention.

The present invention additionally provides method for controlling bearing corrosion in diesel engines comprising lubricating the diesel engine with the lubricating oil composition the present invention.

Among other factors, the present invention is based on the surprising discovery that the unique combination of one or more EC-treated polyalkene succinimides and one or more borated polyalkene succinimides with a specific phenolic antioxidant provides decreased bearing corrosion and decrease valve train wear.

DESCRIPTION OF THE INVENTION

This invention relates to a lubricating oil additive package comprising one or more borated succinimides, one or more EC-treated succinimide and one or more phenolic antioxidants. Another embodiment of this invention relates to one or more lubricating oil compositions comprising one or more of the additive formulations of this invention. Lubricating oil compositions of this invention may be used for any purpose, but are particularly applicable for lubricating engines, in particular internal combustion engines and more particularly heavy duty diesel engines. Lubricating oil compositions of this invention are particularly beneficial for lowering wear and deposits in engines and particularly in internal combustion engines and heavy duty diesel engines. Lubricating oil compositions of this invention are particularly beneficial for improving dispersion of soot in engines such as heavy duty diesel engines and at the same time for controlling bearing wear and valve train wear.

I. Additive Package of this Invention

The additive package of this invention may comprise one or more EC-treated dispersants, one or more borated dispersants, and one or more phenolic antioxidants. Other additives traditionally used in lubricating oils may also be used.

The additive package of this invention may be prepared by physically mixing the borated dispersant, the EC-treated dispersants, and the phenolic antioxidants. The EC-treated dispersant, borated dispersant, and the phenolic antioxidants of the additive package of this invention may have a slightly different composition than the initial mixture, because the components may interact.

I. (A). EC-Treated Dispersants and Borated Dispersants

One embodiment of this invention comprises EC-treated dispersants and borated dispersants that are succinimides. The borated dispersants and EC-treated dispersants used in the additive formulation of this invention are described in U.S. Pat. No. 5,861,363, which is incorporated herein by reference in its entirety.

I. (A)(1). EC-Treated Dispersant

The additive package of this invention may comprise from about 10% to about 80%, preferably from about 20% to about 60%, and more preferably from about 30% to about 50% of an EC-treated dispersant derived from the reaction product of a polyisobutenylsuccinic anhydride with a polyamine. Unless otherwise specified, all percents are wt. %.

The additive formulation of this invention comprises a sufficient amount of one or more EC-treated dispersants to provide the lubricating oil of this invention with greater than 0 to about 10% EC-treated dispersant. Preferred lubricating oils of this invention may comprise an additive formulation that provides the lubricating oil of this invention with about 2% to about 9% EC-treated dispersant. Most preferred lubricating oils of this invention may comprise an additive formulation that provides the lubricating oil of this invention with about 4% to about 8% EC-treated dispersant.

The lubricating oil of this invention may comprise greater than 0 to about 10% EC-treated dispersant. Preferred lubricating oils of this invention may comprise an additive formulation that provides the lubricating oil of this invention with about 2% to about 9% EC-treated dispersant. Most preferred lubricating oils of this invention may comprise about 4% to about 8% EC-treated dispersant.

The EC-treated dispersant is a polybutene succinimide derived from polybutenes having a molecular weight of at least 1800, preferably from 2000 to 2400. The EC-treated succinimide of this invention is described in U.S. Pat. Nos. 5,334,321 and 5,356,552. It is not a mixture of a polybutene succinic acid derivative, a copolymer and a polyamine such as taught in U.S. Pat. No. 5,716,912. The additive package of the present invention comprises from 10% to 50% of a borated dispersant derived from a lower molecular weight polyalkylene and from 50% to 90% of an EC-treated dispersant derived from a higher molecular weight polyalkylene.

I. (A)(2). Borated Dispersant

The additive package of this invention may comprise greater than 0 to about 40%, preferably from 5% to 30%, and more preferably from 10% to 20% of a borated dispersant derived from the reaction product of a polyisobutenylsuccinic anhydride with a polyamine. Preferably, the borated dispersant is derived from polybutenes having a molecular weight of from 1200 to 1400, most preferably about 1300.

The lubricating oil of this invention comprises a sufficient amount of one or more borated dispersants to provide the lubricating oil of this invention with greater than 0 to about 6% borated dispersant. Preferred lubricating oils of this invention may comprise an additive formulation that provides the lubricating oil of this invention with about 1% to about 5% borated dispersant. Most preferred lubricating oils of this invention may comprise an additive formulation that provides the lubricating oil of this invention with about 1% to about 4% borated dispersant.

The lubricating oil of this invention may comprise greater than 0 to about 6% borated dispersant. Preferred lubricating oils of this invention may comprise about 1% to about 5% borated dispersant. Most preferred lubricating oils of this invention may comprise about 1% to about 4% borated dispersant.

I. (B). Phenolic Antioxidant

The additive formulation of this invention may comprise phenolic antioxidants.

One embodiment of this invention may comprise one or more phenolic antioxidants derivatives. The phenolic antioxidant derivatives of this invention may comprise hindered phenol derivatives. Hindered phenol derivatives may comprise functionalized hindered phenols. Functional groups that may be used to functionalize hindered phenols of this invention may include but are not be limited to esters, thioesters, alkyl groups other than tertiary butyl, amines, ketones, amides, sulfoxides or sulfones.

Embodiments of this invention may comprise hindered phenols that are free of tri-tertiary butyl phenols as well as hindered phenols that may comprise of tri-tertiary butyl phenols.

Any state of hindered phenol may be used, but liquid hindered phenols are preferred. Hindered phenols that are not liquid may be dissolved in oil for ease of handling, but this is not required for this invention.

Hindered phenol antioxidants are preferred. One embodiment of this invention may comprise one or more of the hindered phenols having the general formulas (1) and (2):

(1)

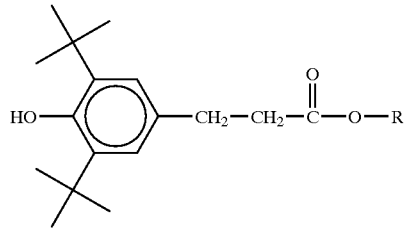

wherein R is a $C_7$ to $C_9$ alkyl group.

(2)

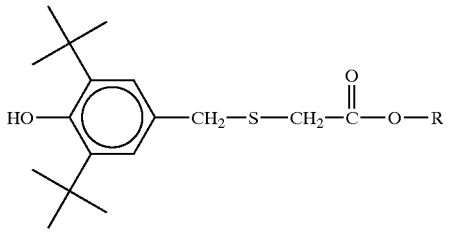

wherein R is a $C_7$ to $C_9$ alkyl group.

Another embodiment of the lubricating oil of this invention may comprise an additive formulation that comprises one or more of 3,5-di-t-butyl 4-hydroxy phenol propionate, which is also known as benzene propanoic acid, 3,5-di-t-butyl 4-hydroxy $C_7$–$C_9$ branched alkyl esters and 3,5-di-tert-butyl-4-hydroxyhydrocinnamic acid, $C_7$–$C_9$ branched alkyl ester; and 2-(4-hydroxy-3,5-di-t-butyl benzyl thiol) acetate, which is also known as [[[[3,5-bis(1,1-dimethyl ethyl)-4-hydroxyphenyl]methyl]thio-]$C_7$–$C_9$ alkyl esters.

The hindered phenol, 3,5-di-t-butyl 4-hydroxy phenol propionate, may be available commercially from Ciba Specialty Chemicals at 540 White Plains Road, Tarrytown, N.Y. 10591 as IRGANOX L135® or Crompton Corporation at 199 Benson Road, Middlebury, Conn. 06749 as Naugard® PS-48. IRGANOX L 135® and Naugard® PS48 are liquid high molecular weight phenolic antioxidants for use in lubricating oils. The hindered phenol, 2-(4-hydroxy-3,5-di-t-butyl benzyl thiol) acetate may be available commercially from Ciba Specialty Chemicals at 540 White Plains Road, Tarrytown, N.Y. 10591 as IRGANOX L118®. IRGANOX L118® is a liquid high molecular weight phenolic antioxidant for use in lubricating oils. Naugard® PS-48, IRGANOX L 135® and IRGANOX L118® are available to the public. These compounds are represented by formulas (1) and (2) wherein R is a $C_7$ to $C_9$ alkyl group.

One embodiment of this invention may comprise one or more hindered phenols that further may comprise one or more of the product sold under the trademark HITEC®, particularly those commercial products having the product numbers 4727, 4727J and 4782J or other hindered phenols that may be commercially available from Ethyl Petroleum Additives Inc., 500 Spring Street, Richmond, Va. 23218.

The additive formulation of this invention comprises greater than about 0 to about 10% hindered phenol. Preferred additive packages of this invention may comprise about from about 1% to about 6% hindered phenol.

The additive formulation of this invention comprises a sufficient amount of one or more hindered phenols to provide the lubricating oil of this invention with greater than 0 to about 2.0 wt. % hindered phenol. Preferred lubricating oils of this invention may comprise an additive formulation that provides the lubricating oil of this invention with about 0.2 wt. % to about 0.8 wt. % hindered phenol.

The lubricating oil of this invention may comprise greater than 0 to about 2.0 wt. % hindered phenol. Preferred lubricating oils of this invention may comprise about 0.2 wt. % to about 0.8 wt. % hindered phenol.

I. (C). Methods of Combining One or More EC-Treated Dispersants, One or More Borated Dispersants and One or More Phenolic Antioxidants The EC-treated dispersants, borated dispersants, and phenolic antioxidants of this invention may be combined in any order and added to lubricating oil separately or as a combination. Other additives traditionally used in lubricating oil may also be used.

II. Additional Additives

The following additive components are examples of some of the components that may be favorably employed in some embodiments of this invention. These examples of additives are provided to illustrate this invention, but they are not intended to limit it:

II. (A). Antioxidants

Embodiments of this invention may include but are not limited to such antioxidants as phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-l-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl). Diphenylamine-type oxidation inhibitors include, but are not limited to, alkylated diphenylamine, phenyl-.alpha.-naphthylamine, and alkylated-.alpha.-naphthylamine. Other types of oxidation inhibitors include metal dithiocarbamate (e.g., zinc dithiocarbamate), and methylenebis (dibutyidithiocarbamate).

II. (B). Wear Inhibitors

Embodiments of this invention may comprise traditional wear inhibitors. As their name implies, these agents reduce wear of moving metallic parts. Examples of such agents include, but are not limited to, phosphates, phosphites, carbamates, esters, sulfur containing compounds, and molybdenum complexes.

II. (C). Rust Inhibitors (Anti-Rust Agents)

Embodiments of this invention may comprise traditional rust inhibitors including, but not limited to:

1. Nonionic polyoxyethylene surface active agents: polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate; and
2. Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

II. (D). Demulsifiers

Embodiments of this invention may comprise traditional demulsifiers including but not limited to addition products of alkylphenol and ethylene oxide, polyoxyethylene alkyl ether, and polyoxyethylene sorbitan ester.

II. (E). Extreme Pressure Agents (EP Agents)

Embodiments of this invention may comprise traditional EP Agents including but not limited to EP Agents that may be used include Zinc dialkyldithiophosphate (primary alkyl, secondary alkyl, and aryl type), sulfurized oils, diphenyl sulfide, methyl trichlorostearate, chlorinated naphthalene, fluoroalkylpolysiloxane, and lead naphthenate.

II. (F). Friction Modifiers

Embodiments of this invention may comprise traditional friction modifiers including but not limited to fatty alcohol, fatty acid, amine, borated ester, and other esters.

II. (G). Multifunctional Additives

Embodiments of this invention may comprise traditional multifunctional additives including but not limited to sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound may be used.

II. (H). Viscosity Index Improvers

Embodiments of this invention may comprise traditional viscosity index improvers including but not limited to polymethacrylate type polymers, ethylene-propylene copolymers, styrene-isoprene copolymers, hydrated styrene-isoprene copolymers, polyisobutylene, and dispersant type viscosity index improvers may be used.

II. (I). Pour Point Depressants

Embodiments of this invention may comprise traditional pour point depressants including but not limited to polymethyl methacrylate may be used.

II. (J). Foam Inhibitors

Embodiments of this invention may comprise traditional foam inhibitors including but not limited to alkyl methacrylate polymers and dimethyl silicone polymers may be used.

III. Oil of Lubricating Viscosity

The oil of lubricating viscosity used in such embodiments may be mineral oils or synthetic oils. A base oil having a viscosity of at least 2.5 cSt at 40° C. and a pour point below 20° C., preferably at or below 0° C. is desirable. The base oils may be derived from synthetic or natural sources. Mineral oils for use as the base oil in this invention include, for example, paraffinic, naphthenic and other oils that are ordinarily used in lubricating oil compositions. Synthetic oils include, for example, both hydrocarbon synthetic oils and synthetic esters and mixtures thereof having the desired viscosity. Hydrocarbon synthetic oils may include, for example, oils prepared from the polymerization of ethylene, i.e., polyalphaolefin or PAO, or from hydrocarbon synthesis procedures using carbon monoxide and hydrogen gases such as in a Fisher-Tropsch process. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as mono-hydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful. The components of the lubricating oil may be combined while heating to a temperature from about 80° F. to about 200° F., preferably about 145° F. to about 155° F. with agitation until all components are mixed. The components of the lubricating oil of this invention may either be mixed together while heating or mixed together and then heated to these temperatures.

IV. Lubricating Oils Compositions

One embodiment of the lubricating oil composition comprises about a minor about of one or more of the additive formulations of this invention and a major amount oil of lubricating viscosity.

One embodiment of this invention is a lubricating oil composition comprising one or more borated succinimides, one or more EC-treated succinimide and one or more phenolic antioxidants and one or more oils of lubricating viscosity.

One embodiment of this invention is a lubricating oil composition comprising a minor amount of one or more borated succinimides, a minor amount of one or more EC-treated succinimide, a minor amount of one or more phenolic antioxidants, and a major amount of one or more oils of lubricating viscosity.

The following examples are included to demonstrate preferred embodiments of the invention. It should be appreciated by those of skill in the art that the techniques disclosed in the examples that follow may represent techniques discovered by the inventors to function well in the practice of the invention, and thus may be considered to constitute preferred modes for its practice. However, those of skill in the art should, in light of the present disclosure, appreciate that many changes may be made in the specific embodiments that are disclosed and still obtain a like or similar result without departing from the spirit and scope of the invention.

EXAMPLES

The examples describe experiments on Samples A through X. The performance of these samples has been evaluated in a number of bench and engine tests, which will be discussed in the various examples.

Sample A was prepared by combining about 7.0% non-EC-treated dispersant, about 2.0% borated dispersant, about 4.2% detergent, about 2.075% wear inhibitor, about 1.2% phenolic anti-oxidant, about 0.05% Mo-based anti-oxidant, about 5 mg/kg foam inhibitor, and Group 1 base oil. Sample A was prepared by combining the components at 150° F. with agitation until all components were mixed.

Sample B was prepared by combining about 7.0% EC-treated dispersant, about 2.0% borated dispersant, about 4.2% detergent, about 2.075% wear inhibitor, about 1.2% phenolic anti-oxidant, about 0.05% Mo-based anti-oxidant, about 5 mg/kg foam inhibitor, and Group 1 base oil. Sample B was prepared by combining the components at 150° F. with agitation until all components were mixed.

Sample C was prepared by combining about 5.0% EC-treated dispersant, about 2.0% non-EC-treated dispersant, about 2.0% borated dispersant, about 3.6% detergent, about 2.075% wear inhibitor, about 1.2% phenolic anti-oxidant, about 0.05% Mo-based anti-oxidant, about 5 mg/kg foam inhibitor, and Group 1 base oil. Sample C was prepared by combining the components at 150° F. with agitation until all components were mixed.

Sample D was prepared by combining about 4.0% EC-treated dispersant, about 2.0% non-EC-treated dispersant, about 3.0% borated dispersant, about 3.6% detergent, about 2.075% wear inhibitor, about 1.2% phenolic anti-oxidant, about 0.05% Mo-based anti-oxidant, about 5 mg/kg foam inhibitor, and Group 1 base oil. Sample D was prepared by combining the components at 150° F. with agitation until all components were mixed.

Sample E was prepared by combining about 3.0% EC-treated dispersant, about 2.0% non-EC-treated dispersant, about 4.0% borated dispersant, about 3.6% detergent, about 2.075% wear inhibitor, about 1.2% phenolic anti-oxidant, about 0.05% Mo-based anti-oxidant, about 5 mg/kg foam inhibitor, and Group 1 base oil. Sample E was prepared by combining the components at 150° F. with agitation until all components were mixed.

Sample F was prepared by combining about 4.0% EC-treated dispersant, about 2.0% non-EC-treated dispersant, about 3.0% borated dispersant, about 4.2% detergent, about 2.075% wear inhibitor, about 0.75% phenolic anti-oxidant, about 0.05% Mo-based anti-oxidant, about 5 mg/kg foam inhibitor, and Group 1 base oil. Sample F was prepared by combining the components at 150° F. with agitation until all components were mixed.

Sample G was prepared by combining about 2.0% EC-treated dispersant, about 4.0% non-EC-treated dispersant, about 3.0% borated dispersant, about 4.2% detergent, about 2.075% wear inhibitor, about 0.75% phenolic anti-oxidant, about 0.05% Mo-based anti-oxidant, about 5 mg/kg foam inhibitor, and Group 1 base oil. Sample G was prepared by combining the components at 150° F. with agitation until all components were mixed.

Sample H was prepared by combining about 4.0% EC-treated dispersant, about 2.0% non-EC-treated dispersant, about 3.0% borated dispersant, about 4.2% detergent, about 2.075% wear inhibitor, about 0.75% phenolic anti-oxidant, about 0.05% Mo-based anti-oxidant, about 5 mg/kg foam inhibitor, and Group 1 base oil. Sample H was prepared by combining the components at 150° F. with agitation until all components were mixed.

Sample I was prepared by combining about 2.0% EC-treated dispersant, about 4.0% non-EC-treated dispersant, about 3.0% borated dispersant, about 4.2% detergent, about 2.075% wear inhibitor, about 0.75% phenolic anti-oxidant, about 0.05% Mo-based anti-oxidant, about 5 mg/kg foam inhibitor, and Group 1 base oil. Sample I was prepared by combining the components at 150° F. with agitation until all components were mixed.

Sample J was prepared by combining about 6.0% EC-treated dispersant, about 4.4% detergent, about 1.83% wear inhibitor, about 0.2% Mo-based anti-oxidant, about 25 mg/kg foam inhibitor, and Group 1 base oil. Sample J was prepared by combining the components at 150° F. with agitation until all components were mixed.

Sample K was prepared by combining about 5.4% EC-treated dispersant, about 2.0% borated dispersant, about 4.4% detergent, about 1.66% wear inhibitor, about 0.2% Mo-based anti-oxidant, about 25 mg/kg foam inhibitor, and Group 1 base oil. Sample K was prepared by combining the components at 150° F. with agitation until all components were mixed.

Sample L was prepared by combining about 4.8% EC-treated dispersant, about 1.9% borated dispersant, about 3.5% detergent, about 1.66% wear inhibitor, about 0.6% phenolic anti-oxidant, about 0.04% Mo-based anti-oxidant, about 4 mg/kg foam inhibitor, and Group 1 base oil. Sample L was prepared by combining the components at 150° F. with agitation until all components were mixed.

Sample M was prepared by combining about 6.0% EC-treated dispersant, about 2.4% borated dispersant, about 4.4% detergent, about 2.075% wear inhibitor, about 0.75% phenolic anti-oxidant, about 0.05% Mo-based anti-oxidant, about 5 mg/kg foam inhibitor, and Group 1 base oil. Sample M was prepared by combining the components at 150° F. with agitation until all components were mixed.

Example 1

Bearing Corrosion Evaluation in Engine Test

The Cummins M11 EGR engine test has been developed by the American Society for Testing and Materials (ASTM). The test is part of the API lubricant specification for diesel engines, CI-4, and measures valve train wear, sludge formation, piston ring wear, and filter plugging. Valve train wear in this test is affected by soot contamination of the lubricating oil. Valve train wear is evaluated by measuring the weight loss of one of the components in the valve train, the crossheads. The conventional approach to valve train wear protection is to properly disperse the soot particles, preventing soot particle agglomeration which could cause an increase in the abrasive wear rate. Soot dispersion capability is provided by dispersant additives.

Samples A and B were tested in the Cummins M11 EGR engine test. Results are presented in Table 1. The results demonstrate that the additive package of this invention provides improved wear protection relative to an additive package where one of the three components described in this invention is not present.

TABLE 1

Valve Train Wear Engine Test Results

| | Sample A | Sample B |
|---|---|---|
| Crosshead Wear, $\mu$m | 35.4 | 14.0 |

Example 2

Bearing Corrosion Bench Test Evaluation

Samples C, D and E were evaluated in a bearing corrosion bench test, the ASTM D-6594 HT CBT test. This bench test has been designed to evaluate corrosion of bearing. In the bearing corrosion bench test, a sample of the candidate oil was exposed to elevated temperature to promote oxidation of the lubricating oil. Three metal coupons (Cu, Pb and Sn) were submersed in the sample during the test. At the end of the test, the amount of Cu, Pb and Sn in the oil sample was determined using the ICP.

Samples C, D and E were evaluated in the bearing corrosion bench test. The results are shown in Table 2. The results indicate increasing levels of the borated dispersant provide improved bearing corrosion inhibition.

TABLE 2

Bearing Corrosion Bench Test Results

| | Sample C | Sample D | Sample E |
|---|---|---|---|
| Used Oil Ci-Content, mg/kg | 6 | 6 | 7 |
| Used Oil Pb-Content, mg/kg | 125 | 79 | 44 |
| Used Oil Sn-Content, mg/kg | 0 | 0 | 0 |

Example 3

Bearing Corrosion Bench Test Evaluation

Samples F through I were evaluated in a bearing corrosion bench test, the ASTM D-6594 HT CBT test. This bench test has been described in Example 2.

Samples F through I were evaluated in the bearing corrosion bench test. The results are shown in Table 3. The results indicate increasing the ratio of EC-treated to non-EC-treated dispersant in the presence of borated dispersant and the phenolic anti-oxidant provides improved bearing corrosion inhibition.

TABLE 3

Bearing Corrosion Bench Test Results

| | Sample F | Sample G | Sample H | Sample I |
|---|---|---|---|---|
| Used Oil Cu-Content, mg/kg | 8 | 10 | 7 | 8 |
| Used Oil Pb-Content, mg/kg | 34 | 41 | 33 | 44 |
| Used Oil Sn-Content, mg/kg | 0 | 3 | 1 | 0 |

Example 4

Piston Deposit Test Evaluation

The DaimlerChrysler OM 441LA engine test has been developed by the Coordinating European Council (CEC) as the CEC L-52-T-97 test. The test is part of the ACEA lubricant specifications for heavy duty diesel engines, E4 and E5, and measures piston deposit formation, liner wear, bore polish, sludge formation, oil consumption and ring sticking. The conventional approach to slow down piston deposit formation is the use of detergents.

Samples J, K and L were tested in the DaimlerChrysler OM 441LA engine test. Results are presented in Table 4 in the form of piston deposit ratings where higher numbers indicate cleaner pistons. The results demonstrate that the additive package of this invention allows for low deposit levels despite the relatively low detergent levels. More specifically, the comparison of results on Samples J and K shows the impact of the inclusion of a borated dispersant.

The comparison of Sample K with Samples L and M shows the impact of the addition of the phenolic anti-oxidant to a formulation that also contains an EC-treated dispersant and a borated dispersant.

TABLE 4

Piston Deposit Engine Test Results

| | Sample J | Sample K | Sample L | Sample M |
|---|---|---|---|---|
| Detergent Treat Rate, wt % | 4.4 | 4.4 | 3.5 | 4.4 |
| Piston Deposit Rating | 19.4 | 29.7 | 37.4 | 34.0 |

CONCLUSION

Data presented in the Examples based on analysis by using the Cummins M11 EGR engine test shows that an unexpectedly low wear was found when lubricating oil compositions of this invention were tested.

Data presented in the Examples based on analysis by using the Bearing Corrosion Bench Test suggest that a 4 to 5 ratio of borated succinimide to EC-treated succinimide is preferred for corrosion protection.

Data presented in the Examples based on analysis using HT CBT studies and the Mack T-10 engine test indicate a positive impact of increasing the ratio of borated succinimide to EC-treated succinimide.

Data presented in the Examples based on analysis by using the DaimlerChrysler OM 441LA engine test program suggests performance benefits of the lubricating oil composition of this invention.

Lubricating engines with the lubricating oil of this invention were found to help to maintain low wear throughout the duration of the M11 EGR crosshead wear test. In this particular test, a phenolic anti-oxidant was used.

What is claimed is:

1. A lubricating oil additive composition comprising:

(a) one or more ethylene carbonate-treated succinimides, (b) one or more borated succinimides, and (c) one or more phenolic antioxidants selected from those of the formulae:

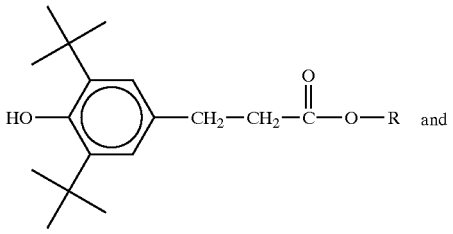

and

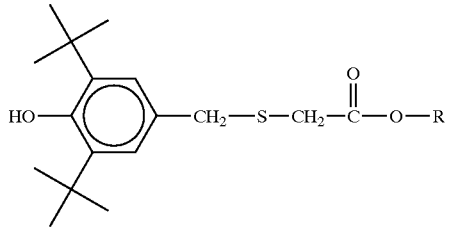

wherein each R is an alkyl group of 7 to 9 carbon atoms.

2. The lubricating oil additive composition of claim 1, wherein the phenolic antioxidant is:

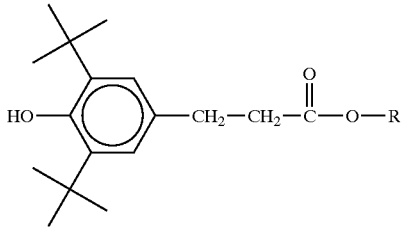

wherein R is an alkyl group of 7 to 9 carbon atoms.

3. The lubricating oil additive composition of claim 1, wherein the phenolic antioxidant is:

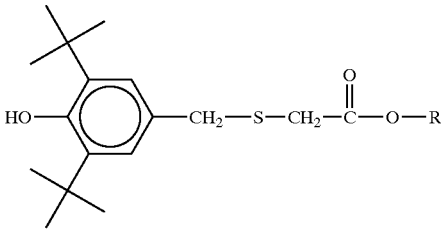

wherein R is an alkyl group of 7 to 9 carbon atoms.

4. The lubricating oil additive composition of claim 1, wherein the ethylene carbonate-treated succinimide is a polybutene succinimide derived from the reaction product of a polyisobutenyl succinic anhydride with a polyamine.

5. The lubricating oil additive composition of claim 4, wherein the ethylene carbonate-treated succinimide is derived from polybutenes having a molecular weight of from at least 1800.

6. The lubricating oil additive composition of claim 1, wherein the borated succinimide is derived from the reaction product of a polyisobutenyl succinic anhydride with a polyamine.

7. The lubricating oil additive composition of claim 6, wherein the borated succinimide is derived from polybutenes having a molecular weight of from 1200 to 1400.

8. A lubricating oil composition comprising a major amount of an oil of lubricating viscosity and a minor amount of the lubricating oil additive composition comprising:

(a) one or more ethylene carbonate-treated succinimides, (b) one or more borated succinimides, and (c) one or more phenolic antioxidants selected from those of the formulae:

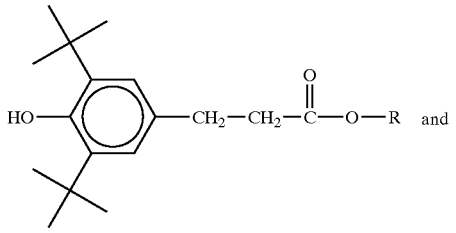

and

-continued

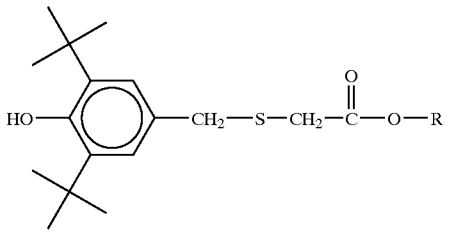

wherein each R is an alkyl group of 7 to 9 carbon atoms.

9. A method of lubricating an engine comprising operating the engine with a lubricating oil composition claim 8.

10. A method for reducing valve train wear in diesel engines comprising lubricating the diesel engine with the lubricating oil composition of claim 8.

11. A method for controlling bearing corrosion in diesel engines comprising lubricating the diesel engine with the lubricating oil composition of claim 8.

12. A method for reducing piston deposit formation in diesel engines comprising lubricating the diesel engine with the lubricating oil composition of claim 8.

* * * * *